United States Patent [19]

Kriechbaum

[11] 4,140,986

[45] * Feb. 20, 1979

[54] CIRCUIT BREAKER SWITCH

[75] Inventor: Karl Kriechbaum, Kassel-Ki, Fed. Rep. of Germany

[73] Assignee: Licentia Patent-Verwaltungs-G.m.b.H., Frankfurt, Fed. Rep. of Germany

[ * ] Notice: The portion of the term of this patent subsequent to Oct. 11, 1994, has been disclaimed.

[21] Appl. No.: 807,322

[22] Filed: Jun. 16, 1977

Related U.S. Application Data

[62] Division of Ser. No. 652,973, Jan. 28, 1976, Pat. No. 4,053,727.

[30] Foreign Application Priority Data

Jan. 31, 1975 [DE] Fed. Rep. of Germany ..... 2503910

[51] Int. Cl.[2] ..... H01H 75/00

[52] U.S. Cl. ..... 335/19; 335/16

[58] Field of Search ..... 335/18, 19, 155, 16

[56] References Cited

U.S. PATENT DOCUMENTS

| | | | |
|---|---|---|---|
| 3,215,797 | 11/1965 | Kesselring et al. | 335/18 |
| 3,364,326 | 1/1968 | Leeds | 335/19 |

*Primary Examiner*—Harold Broome

*Attorney, Agent, or Firm*—Spencer & Kaye

[57] ABSTRACT

A circuit breaker switch for periodic current has a stationary contact connected to a first current terminal; a movable contact connected to a second terminal and having a closed position in which it engages the stationary contact and an open position in which it is separated from the stationary contact, an actuating device for moving the movable contact; a locking device having an operative position in which it immobilizes the movable contact in its closed position and an inoperative position in which it is clear of the movable contact; and a current intensity-responsive device connected to the locking device for moving the locking device from its inoperative position to its locking position when the intensity of current flowing through the circuit breaker switch exceeds a first predetermined value and for moving the locking device from its locking position into its inoperative position when the intensity reaches a second predetermined value.

11 Claims, 4 Drawing Figures

CIRCUIT BREAKER SWITCH

CROSS-REFERENCE TO RELATED APPLICATION

This is a division of application Ser. No. 652,973, filed Jan. 28, 1976, now U.S. Pat. No. 4,053,727.

BACKGROUND OF THE INVENTION

This invention relates to a heavy-duty circuit breaker switch, for example, a gas current arc blow-out switch. In case the switch interrupts a high-intensity periodic current (for example, in excess of 40 kA) caused by a short circuit, the electric arc drawn between the movable and stationary contacts is particularly powerful. In known circuit breakers, the separation of contacts is effected when a predetermined current intensity is exceeded; regarding the extinguishability of the arc an optimum moment of current interruption related to the momentary amplitude of the high-intensity periodic current has not been considered or taken into account.

SUMMARY OF THE INVENTION

It is an object of the invention to provide an improved circuit breaker for periodic current which, when the current intensity exceeds a predetermined magnitude, permits a circuit breaking operation only in a predetermined synchronism with the phase of the current.

This object and others to become apparent as the specification progresses, are accomplished by the invention, according to which, briefly stated, the heavy duty circuit breaker switch for periodic current has a stationary contact connected to a first current terminal; a movable contact connected to a second current terminal and having a closed position in which it engages the stationary contact and an open position in which it is separated from the stationary contact, an actuating device for moving the movable contact; a locking device having an operative position in which it immobilizes the movable contact in its closed position and an inoperative position in which it is clear of the movable contact; and a current intensity-responsive device connected to the locking device for moving the locking device from its inoperative position to its locking position when the intensity of current flowing through the circuit breaker switch exceeds a first predetermined value, and for moving the locking device from its locking position into its inoperative position when the intensity reaches a second predetermined value.

DESCRIPTION OF THE PREFERRED EMBODIMENT

Figure 1:
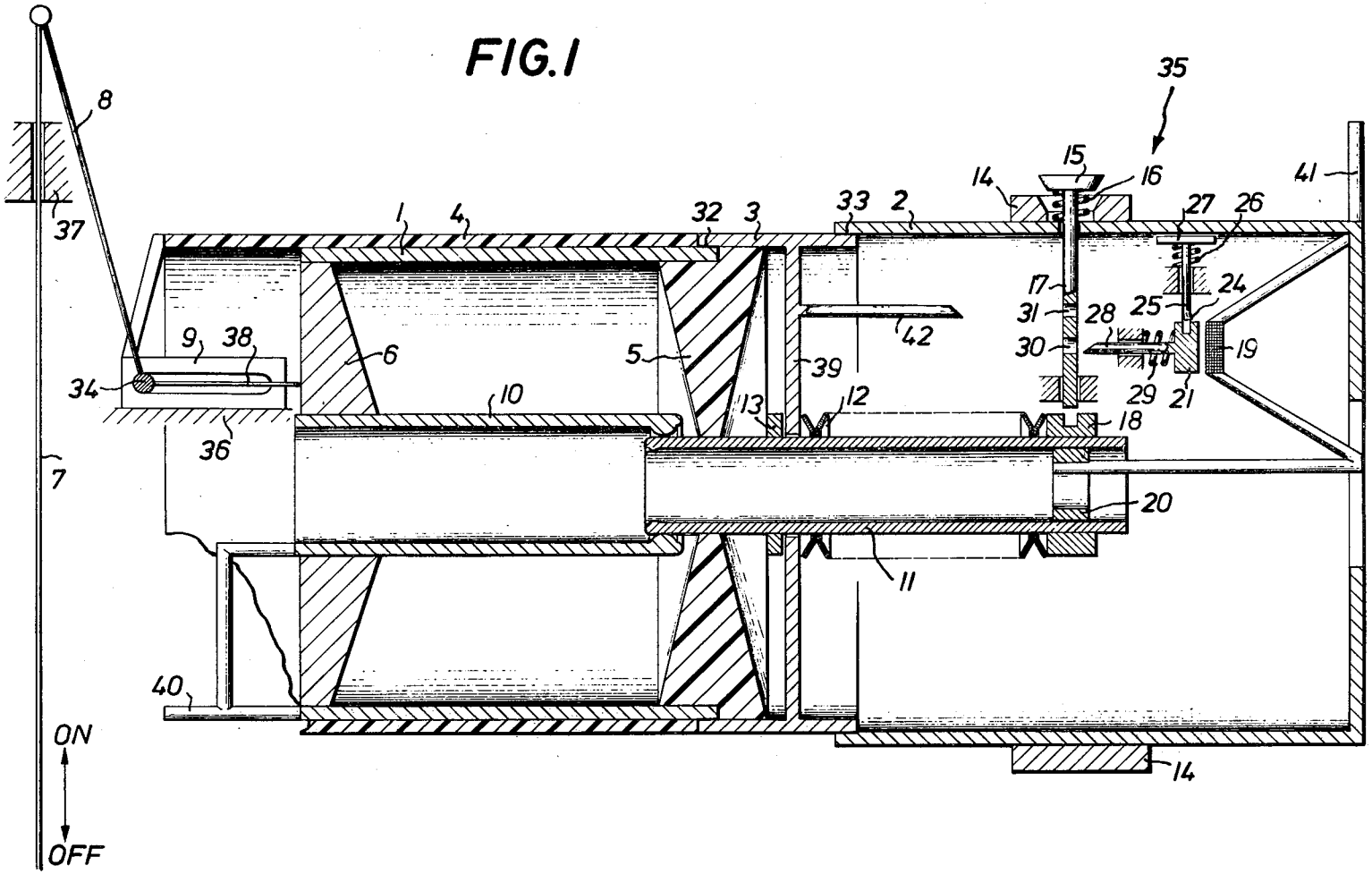
FIG. 1 is a longitudinal schematic sectional view of one pole of a two-pole heavy duty switch incorporating a preferred embodiment of the invention, shown in a closed position.
Figure 2:
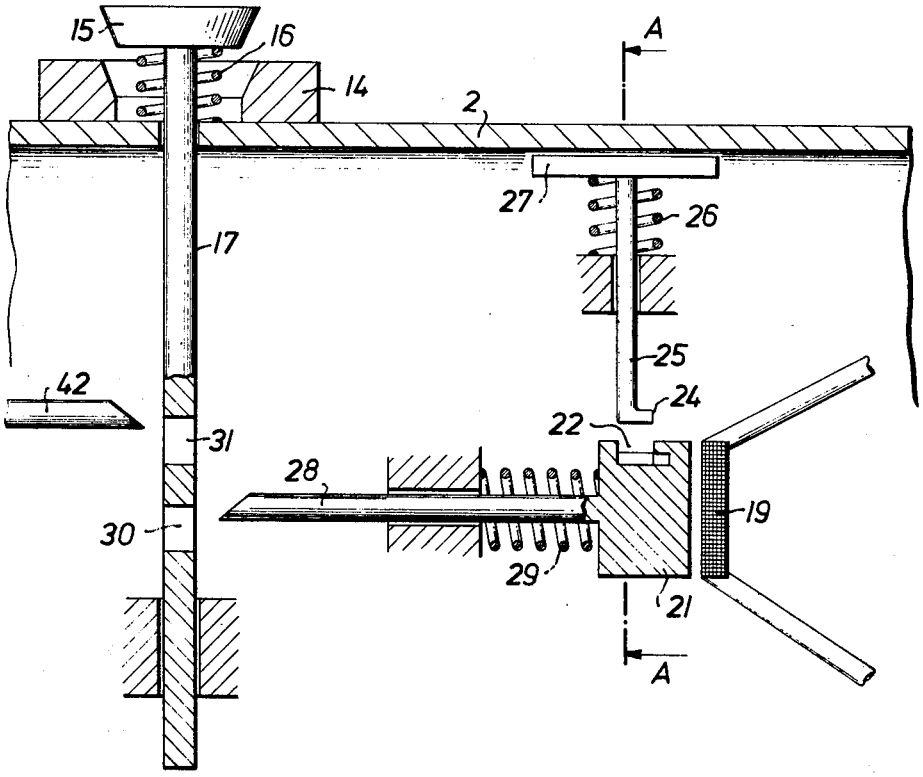
FIG. 2 is a schematic enlarged detail of FIG. 1.

Turning now to FIG. 1, there is illustrated only the right-hand pole of a two-pole switch arranged on an insulator column. The left-hand pole corresponds to the mirror-image of the right-hand pole. The gas-tight outer housing of the switch pole and the pole column are not shown. The housing and the pole column are filled with an extinguishing gas at a pressure of approximately 3 atmospheres. This switch, to be now described, represents an exemplary environment in which the invention may find application.

The pole includes external current terminals 40 and 41 which are electrically connected with a hollow stationary contact pin 10 and with a movable contact comprising a hollow movable contact pin 11, respectively. The contact pin 10 is secured within an electrically conducting compression cylinder 1. The compression cylinder 1, the stationary contact 10 and the movable contact pin 11 are arranged coaxially with respect to one another.

One end of the cylinder 1 is closed off by an annular piston 6 which surrounds the stationary contact pin 10 and is slidable with respect thereto and with respect to the cylinder 1. The other end of the compression cylinder 1 is closed by a nozzle 5 which has a central opening slidably and sealingly receiving the movable contact pin 11.

An electrically conducting fixed member, constituted by a stationary tube 2 is supported coaxially with and spaced from the compression cylinder 1. An electrically conducting contact bridge 3, forming part of the movable contact, is slidably received at 33 in the stationary tube 2 and is in continuous electric contact with the movable contact pin 11. The contact bridge 3 has an advanced, or closed position (shown in FIG. 1) in which its contact terminus 32 is in engagement with the cylinder 1 and a withdrawn, or open position in which it is spaced from the cylinder 1. An insulator tube 4 is slidably received on the compression cylinder 1. The contact bridge 3 is displaced by the insulator tube 4 by virtue of a mechanism described below.

The electric connection between the terminal 41 and the movable contact pin 11 is effected by means of a coil 19 and an annular slide contact 20 which is arranged in the inside of the hollow contact pin 11. Further, the current terminals 40 and 41 are, for conducting the rated current, connected with one another through the wall of the cylinder 1, the rated current contact 32, the contact bridge 3, the slide contact 33 and the tube 2.

For performing the circuit breaking operation, a pull rod 7 made of insulating material and positioned in the pole column (not shown) and guided in a support 37, is moved downwardly by means of a drive mechanism (also not shown). To the upper terminus of the pull rod 7 there is articulated a first push rod 8 which, at its other end, is secured to a drive pin 34. The push rod 8 need not be made of insulating material. The drive pin 34 is supported in a slot of a carriage 9 which is displaceable on a support 36. The drive pin 34 is coupled with the piston 6 by means of a second push rod 38.

Upon downward motion of the pull rod 7, the piston 6 is, by means of the push rods 8 and 38, displaced towards the right as viewed in FIG. 1. As a result, the gas enclosed in the annular space between the cylinder 1 and the stationary contact pin 10 is compressed. A premature escape of the gas is prevented by the movable contact 11 sealingly engaging the stationary nozzle 5.

The linkage system 7, 8 and 38 is advantageous in that the pulling force generated in the pull rod 7 and necessary for the circuit breaking operation, does not increase despite the significantly increased pressure exerted on the piston 6 at the end of its displacement. For this reason, a compression of the gas up to a very small residual volume is possible. Since the push rod 8 forms, at the end of the compressing motion of the piston 6, an angle of approximately 90° with the pull rod 7, the linkage system is adapted to take up the further increasing counterpressure caused by an arc drawn between the opened contacts 10 and 11 and exerted on the piston 6.

After the pin 34 abuts the right-hand terminus (limit position) of the slot in the carriage 9, at which time there is already achieved a certain pre-compression of the gas in the cylinder 1, the carriage 9 is moved by and with the pin 34. The thrust generated upon the start of carriage motion is taken up by a damping device, not shown. The motion of the carriage 9 is transmitted to the contact bridge 3 by means of the insulating cylinder 4 affixed to the carriage 9. The rated current separation occurs as the contact 32 separates from the cylinder 1. Only after completing the interruption of the rated current is the movable contact 11 displaced towards the right by means of a radial projection 39 arranged on the contact bridge 3 and a biased disc spring stack 12 engaging the radial projection 39 and an annulus 18 affixed to the outer face of the movable contact 11. By this time the gas prevailing in the cylinder 1 is compressed to a very small residual volume. The arc drawn between the contacts 10 and 11 is put out by a powerful gas blast as the compressed extinguishing gas escapes through the separated hollow contacts 10 and 11.

The circuit making operation is carried out in a reverse manner. For this purpose, the pull rod 7 is moved upwardly. In the illustrated example of the drive, the pull rod 7 has to be so designed that it is also able to transmit pushing forces which, however, are significantly smaller than the pulling forces generated during circuit breaking. The pull rod 7 can be completely relieved of pressure forces if, for example, between the stationary support 37 and the upper terminus of the pull rod 7 there is inserted a compression spring (not shown).

As a result of the rearward motion of the piston 6 (that is, towards the left, as viewed in FIG. 1), the cylinder 1 is again charged with gas. Such charging can be assisted by check valves (not shown) arranged in the piston 6 or the nozzle 5.

The closing (leftward) motion of the rated current contact 32 and the power contact 11 occurs subsequent to the partial filling of the cylinder 1, after the pin 34 has abutted against the left-hand terminus (limit position) of the slot in the carriage 9. The contact bridge 3 is moved back into its closed, circuit making position by the insulating cylinder 4 affixed to the carriage 9 and the contact bridge 3. The movable contact pin 11 is shifted back into its circuit making position by the radial projection 39 in cooperation with a ring 13 attached to the pin 11. An engagement of the contact pins 10 and 11 occurs before the closing of the rated current contact 32.

The circuit breaking structure described so far in conjunction with FIG. 1 represents an exemplary environment in which the synchronous triggering device forming the subject of this invention may find advantageous application. It will become apparent as the specification progresses, that the synchronous triggering device generally indicated at 35 increases the circuit breaking capacity of the switch in which it is incorporated. It is an important function of the device 35 to block, as a function of the current intensity, the motion of the movable contact (component 11 in the given example) of the circuit breaker.

The purpose of the synchronous triggering device is to ensure that in case of circuit breaking operations for interrupting a high-intensity current (for example, in excess of 40 kA) caused by a short circuit, the separation of the contacts 10 and 11 occurs at an accurately defined part of the current half-wave, that is, at a moment shortly after the current maximum. In this manner, the switch is capable of interrupting the current at the next subsequent zero point of the current intensity.

In the description of which follows, the structure and the mode of operation of the synchronous triggering device 35 will be explained.

As a predetermined value of the short-circuited current is exceeded, a solenoid armature 15 affixed to one end of a locking pin 17 is attracted by a solenoid annulus 14 (attached to the tube 2) against the force of a spring 16. As a result, the lower end of the pin 17, the path of travel of which is substantially normal to that of the contact pin 11, projects into a recess or groove of the ring 18 affixed to the contact pin 11 and thus the pin 11 is immobilized.

Figure 3:
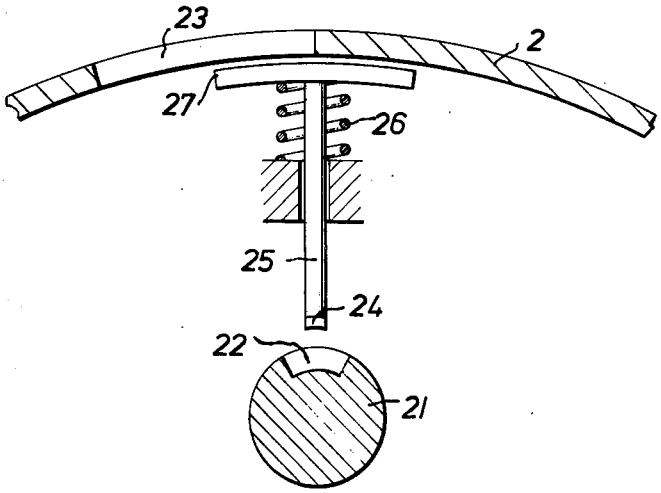
FIG. 3 is a schematic sectional view taken along line A—A of FIG. 2.

By means of the short-circuited current flowing through the tube 2, a further locking pin 25, which is provided at one end with a plate 27, is pushed downwardly by electrodynamic forces against the force of a spring 26, with a frequency of 100 Hz, assuming a 50-cycle current. It will be understood that the plate and the spring, if necessary, should be adjusted to provide for a 120 Hz vibration in case of a 60-cycle current. To ensure that a repelling effect is generated, the tube 2 is provided with a slot 23 as shown in FIG. 3. As may be observed, the plate 27 is in an at least partial overlap with the slot 23.

The pin 25 has, at its lower terminus, a lug 24 which in its lower position, projects into a recess or groove 22 of a short-circuiting ring 21. The spring 26 is so designed that approximately between the moments $t_2$ and $t_3$ (FIG. 4) the pin 25 is in its upper position and between moments $t_3$ and $t_4$ it is in its lower position. The curve F represents the repelling force exerted on the plate 27. This force is proportionate to the square of the short-circuited current I.

There is further provided a camming pin 28 which has a skewed free end that is adapted to project into an opening 30 provided on the locking pin 17. The other, right-hand terminus of the camming pin 28 is connected with the short-circuiting ring 21. The latter is adapted to be repelled by the electrodynamic force of the short-circuited current which flows in the adjacent coil 19 after the separation of the rated current contact 32. The short-circuiting ring 21 is repelled against the force of a spring 29. It is seen that the path of travel of the camming pin 28 is substantially normal to that of the locking pin 17, while the path of travel of the locking pin 25 is substantially normal to that of the camming pin 28.

Figure 4:
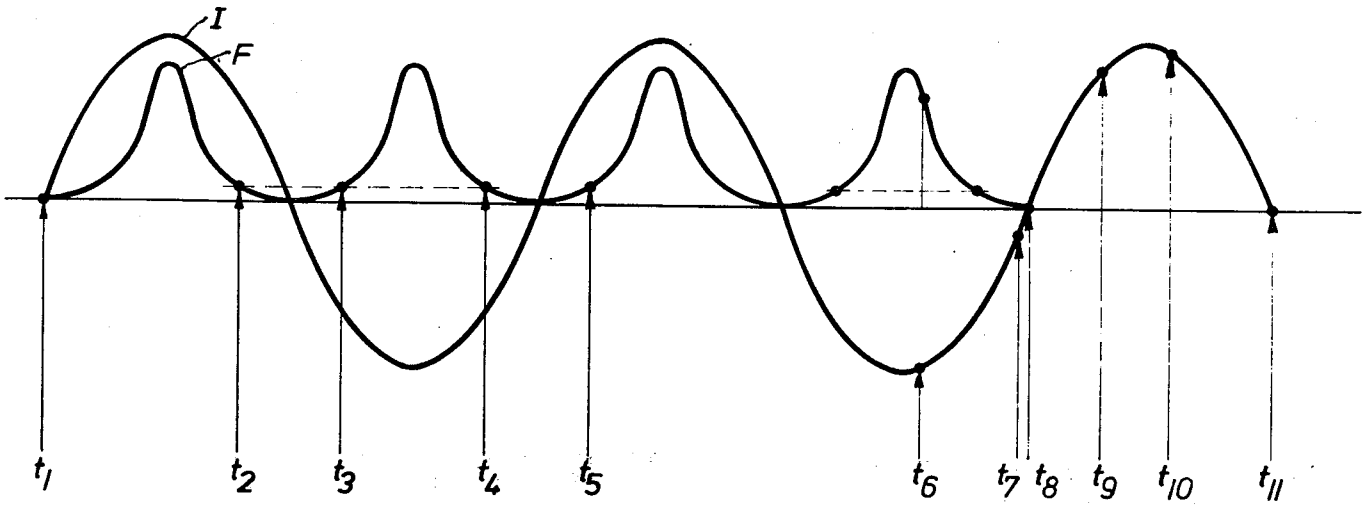
FIG. 4 is a diagram illustrating the current change during circuit breaking.

The course of the circuit breaking operation for a short-circuited current in excess of 40 kA (a first predetermined intensity value) will now be described in connection with FIG. 4.

At moment $t_1$ the flow of the short-circuited current starts. The locking pin 17 is pulled downward and thus blocks the contact pin 11. Simultaneously, the locking pin 25 begins to vibrate with a frequency of 100 Hz (assuming a 50-cycle current). The magnetic system 14, 15, together with the locking pin 17 is, however, so designed that the pin 17 does not vibrate but, due to its inertia, dwells in its lower position.

Let it be assumed that approximately at moment $t_5$ the switch receives the command signal to start the circuit-breaking operation. The separation of the rated current contact 32 may occur at the assumed moment $t_6$, several half-waves after the beginning of the short-circuited current flow. Immediately after the separation of the rated current path, the short-circuited current diverts itself onto the still-locked contact pins 10 and 11. The current thus will drop to zero in the principal current path 1,3,2. The insulator cylinder 4 moves further forward (that is, towards the right as viewed in FIG. 1) and compresses the spring 12. The current now flowing through the coil 19 exerts a repelling force on the short-circuiting ring 21 which, however, is still locked by the pin 25. The lug 24, which is hooked into the recess or groove 22, prevents an upward motion of the pin 25.

At moment $t_8$, shortly before the short-circuited current passes through the zero value, the spring 29 forces the camming pin 28 towards the right against the decreasing repelling force generated by the current flowing through the coil 19. As a result, the pin 25 is released (unlatched) and is moved upwardly by the spring 26. Since the current is zero in the principal current path, the pin 25 remains in its upward position.

Assuming that the interruption of the rated current occurs at moment $t_7$ (rather than at moment $t_6$ as previously assumed), the pin 26 is, in the course of its vibration, in its upper position and remains there. The repelling force generated by the current flowing through the coil 19 has not yet reached the magnitude which is sufficient to move the camming pin 28 towards the left against the force of the spring 29.

Whether the rated current is interrupted at moment $t_6$ or $t_7$, the released pin 28 moves, approximately at moment $t_9$, by virtue of the force generated by the current flowing in the coil 19 (and having a second predetermined intensity value), against the force of the spring 29 towards the left. The skewed terminal face of the pin 28 which constitutes a cam face and which projects into the opening 30 of the pin 17 drives the pin 17 in the upward direction against the force of the spring 16 as well as against the force exerted by the pin 11 due to the attracting force of the magnet ring 14. As a result, the contact pin 11 is released by the locking pin 17 at moment $t_9$ and is accelerated towards the right by the armed spring 12. Thus, by means of a non-rigid coupling between the movable rated current contact 3 and the movable power contact 11 effected by the spring 12 and by virtue of the short-period locking of the power contact 11 with subsequent synchronous triggering, the circuit breaking capacity is significantly increased. The pin 17 is, by means of another camming pin 42 which projects with its skewed terminal face into the opening 31 of the pin 17, moved upwardly for safety reasons in the open end position of the contact bridge 3 independently from the pin 28. The path of travel of the camming pin 42 is substantially normal to that of the locking pin 17.

The separation of the contacts 10 and 11 occurs at moment $t_{10}$. A damping mechanism (not shown) is provided for braking the motion of the contact pin 11 which is of lightweight structure.

During the period $t_{10}$-$t_{11}$ an electric arc burns between the pins 10 and 11 which is exposed to a powerful gas blast as the highly compressed gas escapes from the cylinder 1 through the separated, hollow contacts 10 and 11. As a result, the arc is extinguished as the short-circuited current passes through its subsequent zero value at moment $t_{11}$.

It is thus seen that the invention may find advantageous application in a circuit breaker of the arc blow-out type, since the moment of contact separation and thus, the arc generation may be selected to occur during decreasing intensity of the periodic current, thus facilitating an arc blow-out by the gas blast.

It will be understood that the above description of the present invention is susceptible to various modifications, changes and adaptations, and the same are intended to be comprehended within the meaning and range of equivalents of the appended claims.

What is claimed is:

1. In a circuit breaker switch for periodic current having a stationary contact connected to a first current terminal; a movable contact connected to a second current terminal and having a closed position in which it engages the stationary contact and an open position in which it is separated from the stationary contact and actuating means for moving the movable contact; the improvement comprising locking means having an operative position in which it immobilizes said movable contact in its said closed position and an inoperative position in which it is clear of said movable contact; first current intensity-responsive means connected to said locking means for moving said locking means from said inoperative position to said locking position when the intensity of current flowing through the circuit breaker switch exceeds a first predetermined value; and second current intensity-responsive means for moving said locking means from said locking position to said inoperative position when the current intensity subsequently reaches a second predetermined value.

2. A circuit breaker switch as defined in claim 1, wherein said locking means includes a slidably supported locking pin having first and second ends and a path of motion substantially perpendicular to the path of motion of said movable contact; a locking pin receiving means carried by said movable contact; in said operative position said locking pin projecting with said first end into said locking pin receiving means and in said inoperative position said locking pin being withdrawn with respect to said locking pin receiving means.

3. A circuit breaker switch as defined in claim 2, further comprising an electrically conducting fixed member being electrically continuously connected to said second current terminal and said movable contact; said first current intensity-responsive means comprising a magnetic ring affixed to said fixed member; and armature affixed to said second end of said locking pin and arranged to cooperate with said magnetic ring; and spring means continuously urging said locking pin into the withdrawn position; said armature being moved against said spring means towards said magnetic ring by magnetic attraction when the current flowing in said fixed member exceeds said first predetermined value for effecting movement of said locking pin into said operative position.

4. A circuit breaker switch as defined in claim 3, said second current intensity-responsive means comprising means defining an opening in said locking pin; a camming pin having first and second ends and a path of motion substantially perpendicular to the path of motion of said locking pin; the first end of said camming pin having a skewed face; said camming pin being movable into an advanced position for penetrating into said opening in said locking pin to move said locking pin, with said skewed face, from the operative position into the inoperative position; said camming pin being movable into a withdrawn position; additional spring means continuously urging said camming pin into its withdrawn position; a short-circuiting ring affixed to the second end of said camming pin; and electrodynamic force-generating means continuously connected to said fixed member and operatively coupled to said short-circuiting ring for displacing said camming pin against said additional spring means into said advanced position when the current flowing in said fixed member exceeds said second predetermined value.

5. A circuit breaker switch as defined in claim 4, further comprising a contact bridge slidably supported by and being in continuous electric contact with said fixed member; said contact bridge being in continuous electric contact with said movable contact; said contact bridge having a closed position in which it electrically contacts said stationary contact and an open position in which it is separated from said stationary contact; said fixed member and said contact bridge constituting a movable rated current contact and said stationary contact constituting a stationary rated current contact; further comprising means defining an additional opening in said locking pin; an additional camming pin having first and second ends and a path of motion substantially perpendicular to the path of motion of said locking pin, the first end of said additional camming pin having a skewed face; said additional camming pin being affixed, at its said second end, to said contact bridge to be movable therewith as a unit; in said open position of said contact bridge, said additional camming pin extending into said additional opening of said locking pin for moving said locking pin, with the skewed face of the additional camming pin, from the operative position into the inoperative position; said additional camming pin assuming a withdrawn position in the closed position of said contact bridge.

6. A circuit breaker switch as defined in claim 4, said second current intensity-responsive means further comprising means defining a recess in said short-circuiting ring; an additional locking pin having first and second ends and a path of motion substantially perpendicular to the path of motion of said camming pin; a locking lug carried on said first end of said additional locking pin; said additional locking pin having an advanced position in which said locking lug projects and hooks into said recess of said short-circuiting ring for immobilizing said camming pin in its withdrawn position, said additional locking pin having a withdrawn position in which said locking lug is clear of said recess in said short-circuiting ring; and means for moving said additional locking pin.

7. A circuit breaker switch as defined in claim 6, wherein said means for moving said additional locking pin includes a further spring means continuously urging said additional locking pin into its withdrawn position; a plate member affixed to said second end of said additional locking pin, said plate member being located adjacent said fixed member to be affected by electrodynamic forces generated by the current flowing in said fixed member for urging said additional locking pin into its advanced position against the force of said further spring means.

8. A circuit breaker switch as defined in claim 7, further comprising means defining a slot in said fixed member; said slot and said plate member being in an at least partial overlap with respect to one another.

9. A circuit breaker switch as defined in claim 4, further comprising a contact bridge slidably supported by and being in continuous electric contact with said fixed member; said contact bridge being in continuous electric contact with said movable contact; said contact bridge having a closed position in which it electrically contacts said stationary contact and an open position in which it is separated from said stationary contact; said fixed member and said contact bridge constituting a movable rated current contact and said stationary contact constituting a stationary rated current contact; wherein said electrodynamic force-generating means includes a coil for carrying the same current that flows through said movable contact when said contact bridge is in its open position and said movable contact is in its closed position.

10. A circuit breaker switch as defined in claim 9, further comprising a slide ring being in continuous sliding contact with said movable contact; said coil having one terminal connected to said slide ring and another terminal connected to said fixed member.

11. A circuit breaker switch as defined in claim 2, wherein said locking pin receiving means comprises a ring affixed to said movable contact and a recess provided in said ring for receiving said first end of said locking pin.

* * * * *